US010937603B1

(12) United States Patent
Vaishnavi et al.

(10) Patent No.: US 10,937,603 B1
(45) Date of Patent: Mar. 2, 2021

(54) ACTUATING SHAFT STRUCTURE FOR AN ELECTRICAL SWITCH

(71) Applicant: Eaton Intelligent Power Limited, Dublin (IE)

(72) Inventors: Romil Vaishnavi, Talab Tillo Jammu (IN); Somnath Devarde, Ichalkaranji (IN); Arthur James Jur, Cleveland, TN (US)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 16/727,087

(22) Filed: Dec. 26, 2019

(51) Int. Cl.

| | |
|---|---|
| ***H01H 3/32*** | (2006.01) |
| ***H01H 3/02*** | (2006.01) |
| ***H01H 9/02*** | (2006.01) |

(52) U.S. Cl.
CPC ..... *H01H 3/32* (2013.01); *H01H 3/02* (2013.01); *H01H 9/02* (2013.01)

(58) Field of Classification Search
CPC ..... H01H 3/54; H01H 3/06; H01H 71/56; H01H 3/10; H01H 3/42; H01H 3/46; H01H 3/08; H01H 3/3021; H01H 2009/0088; H01H 3/58; H01H 3/32; H01H 9/02; H01H 3/02
See application file for complete search history.

(56) References Cited

U.S. PATENT DOCUMENTS

| | | | | |
|---|---|---|---|---|
| 10,483,058 | B2 | 11/2019 | Vaishnavi et al. | |
| 2012/0199452 | A1* | 8/2012 | Dahl | H01H 73/045 200/11 R |
| 2018/0061601 | A1* | 3/2018 | Oh | H01H 71/10 |

OTHER PUBLICATIONS

U.S. Appl. No. 15/7647,303, "Electrical Switching Apparatus with Springs and Shunt Trip Mechanism", filed Oct. 30, 2017.
U.S. Appl. No. 16/270,875, "Electrical Switching Mechanism Control Apparatus", filed Feb. 8, 2019.

* cited by examiner

*Primary Examiner* — Ahmed M Saeed
(74) *Attorney, Agent, or Firm* — Benesch, Friedlander, Coplan & Aronoff LLP

(57) ABSTRACT

A electrical pole unit includes an actuator shaft that is rotatable about a switch axis to switch the pole unit between open and closed conditions. The actuator shaft is configured to mate coaxially with another actuator shaft in another pole unit to transmit rotation from one actuator shaft to another without a fastener to interconnect the shafts.

20 Claims, 5 Drawing Sheets

ACTUATING SHAFT STRUCTURE FOR AN ELECTRICAL SWITCH

TECHNICAL FIELD

This technology relates to an electrical switching mechanism including pole units having electrical contacts.

BACKGROUND

An electrical switch, such as a safety switch or disconnect, may be housed in a cabinet. The switch may include pole units having electrical contacts. A switching mechanism may be connected with the pole units to switch the pole units between open and closed conditions manually by the use of a handle at the exterior of the enclosure.

SUMMARY

A electrical pole unit includes an actuator shaft that is rotatable about a switch axis to switch the pole unit between open and closed conditions. The actuator shaft is configured to mate coaxially with another actuator shaft in another pole unit to transmit rotation from one actuator shaft to another without a fastener to interconnect the shafts.

DETAILED DESCRIPTION

Figure 1:
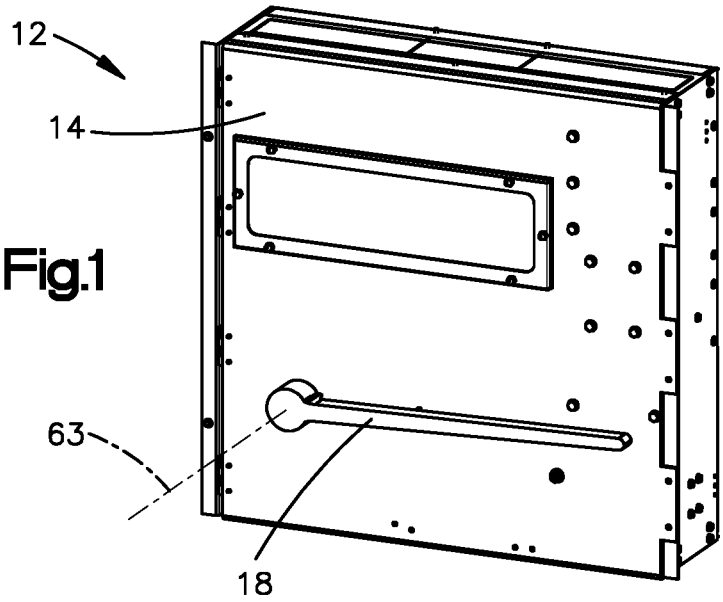
FIG. 1 is a front perspective view of an electrical cabinet containing a switching apparatus.

The apparatus illustrated in the drawings includes parts that are examples of the elements recited in the claims. The illustrated apparatus thus includes examples of how a person of ordinary skill in the art can make and use the claimed invention. They are described here to provide enablement and best mode without imposing limitations that are not recited in the claims. One or more of the elements of one embodiment may be used in combination with, or as a substitute for, one or more elements of another as needed for any particular implementation of the claimed invention.

As shown in FIG. 1, an apparatus 10 includes a cabinet 12 for electrical equipment. The cabinet 12 has a door 14. A manually operated handle 18 at the front side of the door 14 is connected with a switching assembly 20 (FIG. 2) inside the enclosure 12. The switching assembly 20 is switched between open and closed conditions by moving the handle 18 pivotally between open and closed positions.

The switching assembly 20 in the illustrated example includes a row of pole units 22. The pole units 22 are alike, and each individual pole unit 22 includes an assembly of electrical contacts that are switchable between open and closed conditions. Each pole unit 22 further includes an actuating shaft 26. Each actuating shaft 26 is linked with the electrical contacts in the respective pole unit 22 to shift the contacts between their open and closed conditions upon rotation of the shaft 26 between open and closed positions. The actuating shafts 26 are centered on a common switch axis 27 reaching horizontally across the inside of the cabinet 12, and are interconnected end-to-end throughout the row of pole units 22 so as to rotate together about the axis 27. The pole units 22 are thereby engaged with one another to be switched together such that all of the pole units 22 in the switching assembly 20 have the same condition, either open or closed, at any given time.

A linkage 30 is provided for rotating the actuator shafts 26 in response to movement of the handle 18. The linkage 30 includes a panel 40 that is supported for sliding movement vertically beside one end of the row of pole units 22. The linkage 30 also includes links 42, 44, 46, and 48. The links 42-48 are pivotally coupled in series between the handle 18 and the panel 40 to slide the panel 40 in response to pivotal movement of the handle 18.

Figure 2:
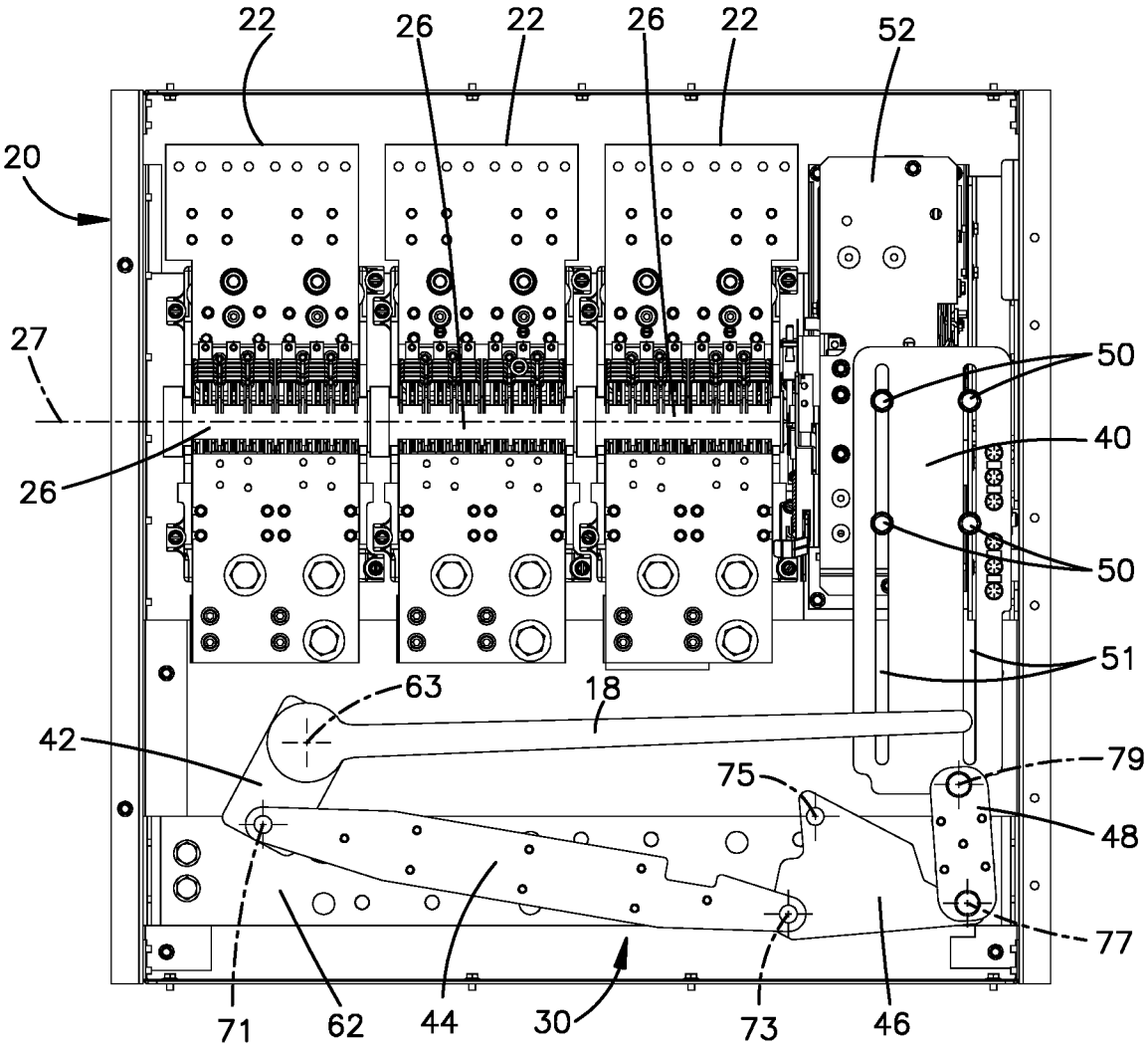
FIG. 2 is front view showing components contained within the cabinet.
Figure 3:
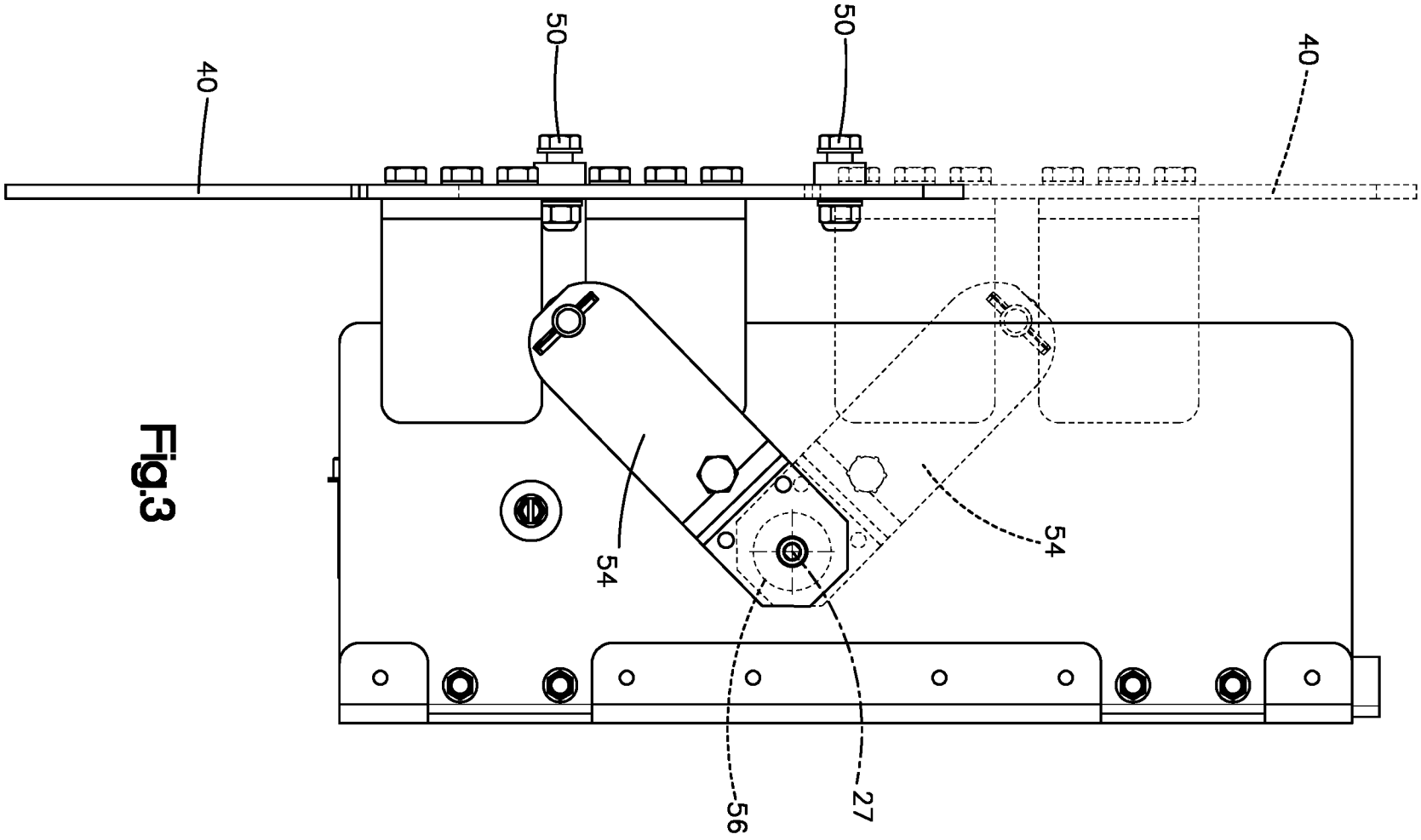
FIG. 3 is an enlarged partial side view of components shown in FIG. 2.

As shown in FIG. 2, guide pins 50 project through slots 51 in the panel 40 to support the panel 40 for sliding movement on a stationary frame 52. As shown in FIG. 3 a lever 54 interconnects the panel 40 with an actuator 56 supported for rotation about the switch axis 27. The actuator 56 is coupled with the actuator shafts 26 in the pole units 22. When the panel 40 moves vertically between the raised and lowered positions shown in FIG. 3, it pivots the lever 54 so as to rotate the actuator 56 and the shafts 26 between their open and closed positions.

A hub 60 (FIG. 4) is mounted for rotation on another stationary frame 62 inside the cabinet 12. The hub 60 defines an axis of rotation 63 for the handle 18. The axis 63 at the hub 60 is horizontal, but is orthogonal to the switch axis 27. Although the hub 60 is rotatable about the axis 63 relative to the frame 62, the axis 63 is fixed relative to the frame 62.

Figure 4:
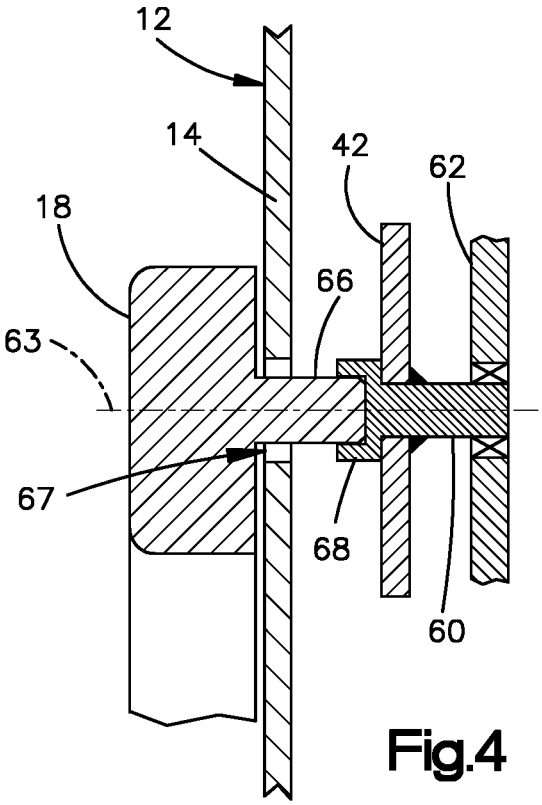
FIG. 4 is an enlarged partial side view of other components shown in FIG. 2.
Figure 5:
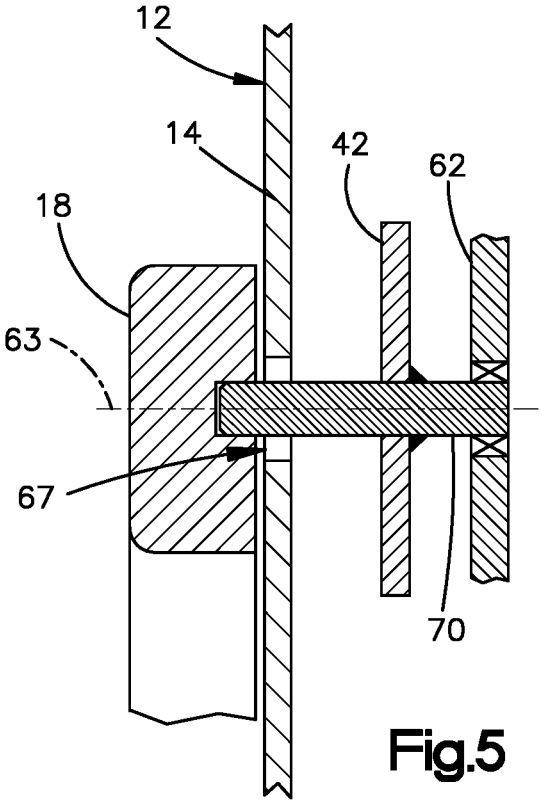
FIG. 5 is a view similar to FIG. 4, showing parts of an alternative embodiment.

In the embodiment of FIG. 4, the handle 18 has an extension 66 configured to project inward through an aperture 67 in the door 14 for coupling in a socket portion 68 of the hub 60. In the alternative embodiment of FIG. 5, a hub 70 is configured to project outward through the aperture 67 in the door 14 for coupling with the handle 18 in a similar manner. In each case, a user standing at the front of the cabinet 12 can couple the handle 18 with the hub 60 or 70 through the aperture 67, and can move the handle 18 pivotally about the axis 63 to operate the linkage 60 for switching the pole units 22 between their open closed conditions, without the need to reach to stand or reach at the side of the cabinet 10.

The first link 42 is fixed to the hub 60 so as to move pivotally about the hub axis 63 upon rotation of the hub 60. The second link 44 is coupled to the first link 42 and the third link 46 for movement pivotally about respective axes 71 and 73. Those axes 71 and 73 are both movable with the second link 44 relative to the frame 62. The third link 46 is mounted on the frame 62 for movement pivotally about another axis 75 that is fixed relative to the frame 62. The fourth link 48 is coupled to the third link 46 and the panel 40 for movement pivotally about respective 77 and 79 axes that are both movable relative to the frame 62.

Figure 6:
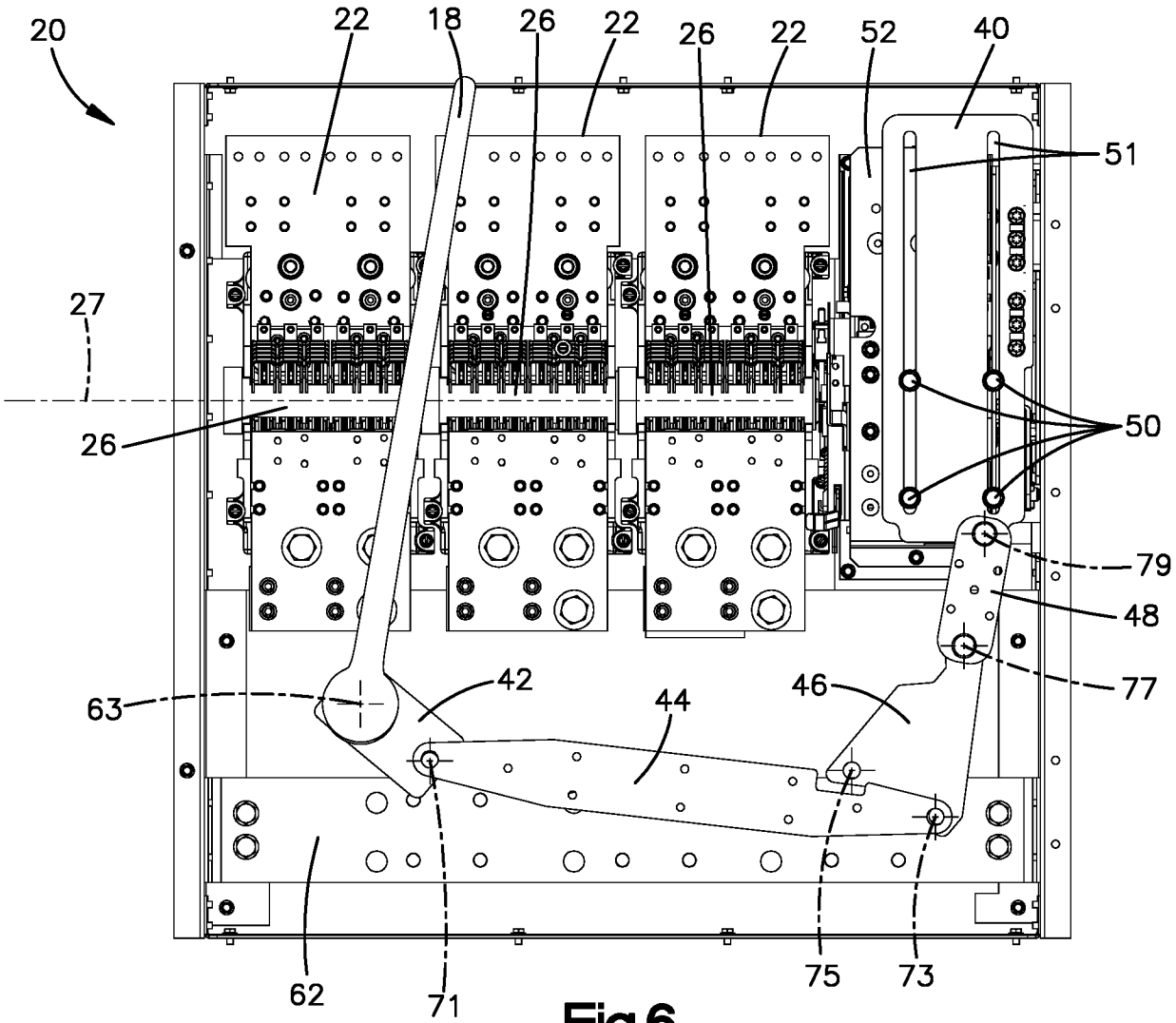
FIG. 6 is a view similar to FIG. 2, showing parts in different positions.

When the handle 18 is in the position of FIG. 2, the switching assembly 20 has an open condition. As the handle 18 is moved from the position of FIG. 2 toward the position of FIG. 6, such movement of the handle 18 drives the hub 60 to rotate in the counterclockwise direction as viewed in the drawings. This drives the first link 42 to push the second link 44 from right to left relative to the frame 62. The second link 44 then drives the third link 46 to pivot in a counter-clockwise direction about the fixed axis 75 on the frame 62. Such movement of the third link 46 pushes the fourth link 48 upward, which lifts the panel 40 upward toward the raised position. As the panel 40 moves into the raised positon, it pivots the lever 46 to rotate the actuator shafts 26 fully to the positons in which they close the contacts in the pole units 22. The reverse process of moving the handle 18 back to the position of FIG. 2 drives the linkage 30 to switch the pole units 22 back to the open conditions.

Figure 7:
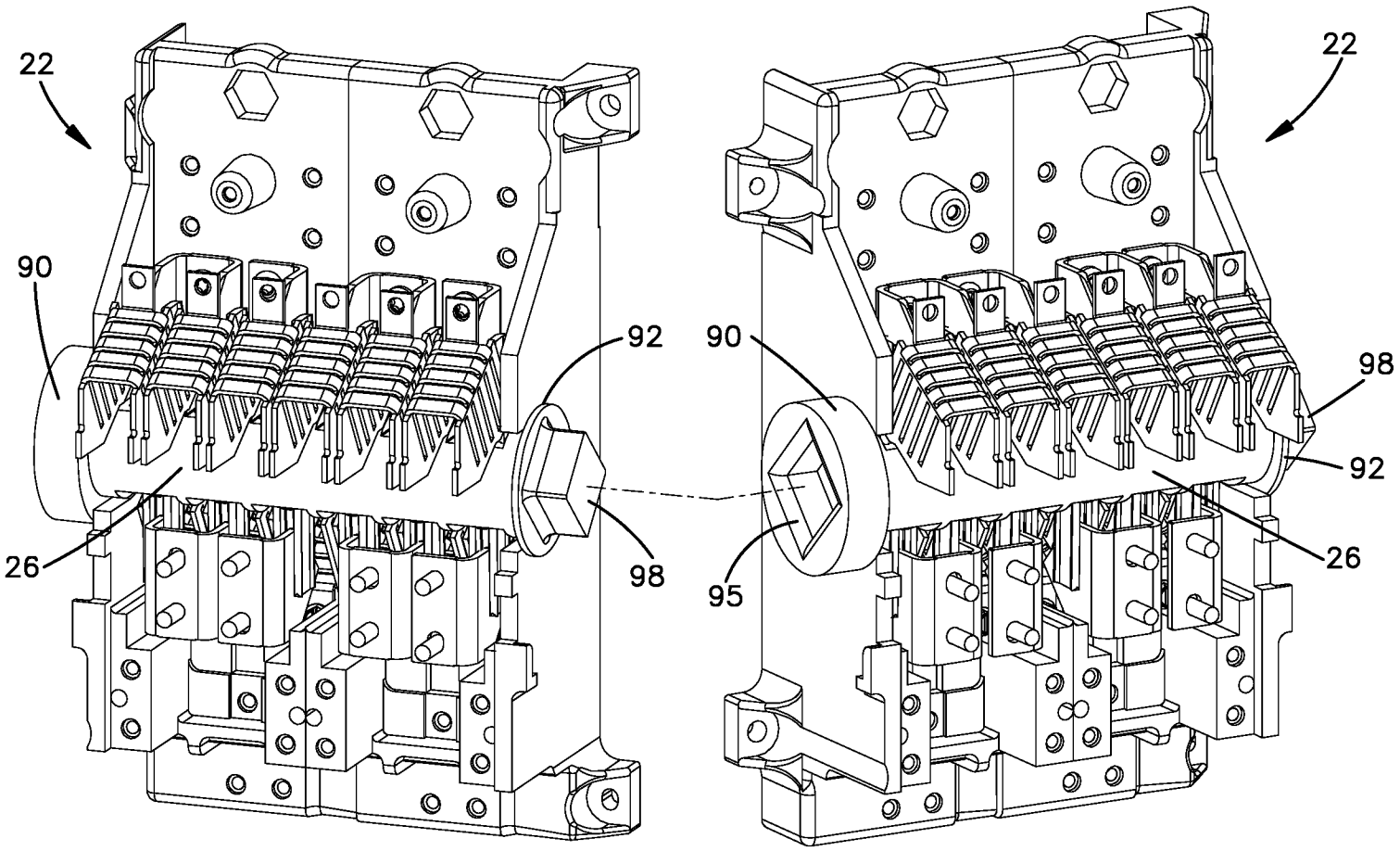
FIG. 7 is a perspective view of two adjacent parts of the switching apparatus.

As shown in FIG. 7, each actuating shaft 26 has opposite end portions 90 and 92. The first end portion 90 of each shaft 26 defines a cavity 95. The second end portion 92 of each shaft 26 defines a hub 98 configured to fit closely within the cavity 95 in an adjacent shaft 26. In the illustrated example, the cavities 95 are rectangular sockets and the hubs 98 have corresponding rectangular shapes. The actuator shaft 26 in each pole unit 22 is thus configured to mate coaxially in end-end engagement with another actuator shaft 26 in an adjacent pole unit 22 to transmit rotation from each shaft 26 to the adjacent shaft 26. The hub and cavity arrangement couples the shafts 26 to rotate together without the use of fasteners to interconnect the shafts 26. Additionally, the individual shafts 26 enable the number of pole units 22 installed in the cabinet 12 to be varied without constraint by the length of a single common shaft throughout the row of pole units 22.

This written description sets for the best mode of carrying out the invention, and describes the invention so as to enable a person of ordinary skill in the art to make and use the invention, by presenting examples of the elements recited in the claims. The detailed descriptions of those elements do not impose limitations that are not recited in the claims, either literally or under the doctrine of equivalents.

What is claimed is:

1. An apparatus comprising:

an electrical pole unit including an actuating shaft that reaches through the pole unit along a switch axis and is rotatable about the switch axis to switch the pole unit between open and closed conditions;

wherein the actuating shaft has an end portion, the end portion defines a cavity that is centered on the switch axis, and the cavity is configured for receiving a hub on an end portion of another actuating shaft in rotation-transmitting engagement; and the actuating shaft further has an opposite end portion defining a hub that is centered on the switch axis and configured for fitting within a cavity in another actuating shaft in rotation-transmitting engagement;

whereby the actuating shaft is configured to mate coaxially with another actuating shaft in another pole unit in rotation-transmitting engagement at locations centered on the switch axis.

2. An apparatus as defined in claim 1, wherein the cavity is a rectangular socket.

3. An apparatus as defined in claim 2, wherein the hub is rectangular.

4. An apparatus as defined in claim 1, wherein the end portion of the actuating shaft projects axially outward at one side of the pole unit.

5. An apparatus as defined in claim 1, wherein the opposite end portion of the actuating shaft projects axially outward at one side of the pole unit.

6. An apparatus as defined in claim 1, wherein the end portion and the opposite end portion of the actuating shaft project axially outward at opposite sides of the pole unit.

7. An apparatus comprising:

a first electrical pole unit including a first actuator shaft that is rotatable about a switch axis to switch the first electrical pole unit between open and closed conditions; and a second electrical pole unit including a second actuator shaft that is rotatable about a switch axis to switch the second electrical pole unit between open and closed conditions;

wherein each of the first and second actuating shafts has an end portion defining a cavity that is centered on the switch axis, and each cavity is configured for receiving a hub on an end portion of another actuator shaft in rotation-transmitting engagement; and wherein each of the first and second actuator shafts further has an opposite end portion defining a hub that is centered on the switch, and each hub is configured for fitting within a cavity in another actuator shaft in rotation-transmitting engagement;

whereby the actuator shafts are configured to mate coaxially in rotation-transmitting engagement at locations centered on the switch axis.

8. An apparatus as defined in claim 7, wherein each cavity is a rectangular socket.

9. An apparatus as defined in claim 8, wherein each hub is rectangular.

10. An apparatus as defined in claim 7, wherein the end portion and the opposite end portion of the first actuating shaft project axially outward at opposite sides of the first electrical pole unit.

11. An apparatus as defined in claim 7, wherein the end portion and the opposite end portion of the second actuating shaft project axially outward at opposite sides of the second electrical pole unit.

12. An apparatus as defined in claim 11, wherein the end portion and the opposite end portion of the first actuating shaft project axially outward at opposite sides of the first electrical pole unit.

13. An apparatus comprising:

a first electrical pole unit including a first actuator shaft that is rotatable about a switch axis to switch the first electrical pole unit between open and closed conditions; and a second electrical pole unit including a second actuator shaft that is rotatable about a switch axis to switch the second electrical pole unit between open and closed conditions;

wherein each of the first and second actuator shafts as an end portion defining a cavity that is centered on the switch axis, and each cavity is configured for receiving a hub on an end portion of another actuator shaft in rotation-transmitting engagement;

wherein each of the first and second actuator shafts further has an opposite end portion defining a hub that is centered on the switch axis, and each hub is configured for fitting within a cavity in another actuator shaft in rotation-transmitting engagement; and the hub on the first actuator shaft is received within the socket on the second actuator shaft;

whereby the actuator shafts are mated coaxially in rotation-transmitting engagement at locations centered on the switch axis.

14. An apparatus as defined in claim 13, wherein each cavity is a rectangular socket.

15. An apparatus as defined in claim 14, wherein each hub is rectangular.

16. An apparatus as defined in claim 13, further comprising a cabinet in which the pole units are contained with the actuator shafts aligned on a horizontal switch axis.

17. An apparatus as defined in claim 16, further comprising a handle and a linkage configured to rotate the actuator shafts in response to movement of the handle pivotally about an axis orthogonal to the switch axis.

18. An apparatus as defined in claim 13, wherein the end portion and the opposite end portion of the first actuating shaft project axially outward at opposite sides of the first electrical pole unit.

19. An apparatus as defined in claim 13, wherein the end portion and the opposite end portion of the second actuating shaft project axially outward at opposite sides of the second electrical pole unit.

20. An apparatus as defined in claim 19, wherein the end portion and the opposite end portion of the first actuating shaft project axially outward at opposite sides of the first electrical pole unit.

* * * * *